US005492212A

United States Patent [19]

Fillod et al.

[11] Patent Number: 5,492,212

[45] Date of Patent: Feb. 20, 1996

[54] DEVICE FOR SORTING AND STORING OBJECTS INSERTED BY WAY OF PAYMENT IN A DISPENSER

[75] Inventors: Maurice Fillod; Jean-Marc Peccoux; Jean-Pascal Delay, all of Besancon, France

[73] Assignee: Schlumberger Industries, Montrouge, France

[21] Appl. No.: 253,117

[22] Filed: Jun. 2, 1994

[30] Foreign Application Priority Data

Jun. 2, 1993 [FR] France ..... 93 06590

[51] Int. Cl.[6] ..... G07D 3/14

[52] U.S. Cl. ..... 194/202; 194/346; 453/3

[58] Field of Search ..... 453/3, 18, 40, 453/41, 43, 49; 194/202, 217, 218, 346

[56] References Cited

U.S. PATENT DOCUMENTS

| | | | |
|---|---|---|---|
| 2,021,984 | 11/1935 | Chase | 194/202 |
| 4,374,529 | 2/1983 | Kobayashi et al. | 453/41 X |
| 4,558,711 | 12/1985 | Yoshiaki et al. | 453/3 |
| 4,836,825 | 6/1989 | Smeets et al. | 453/49 |
| 4,946,418 | 8/1990 | DeFeo | 453/40 X |
| 5,040,658 | 8/1991 | Levasseur | 194/346 |
| 5,056,643 | 10/1991 | Kirberg | 194/202 |

FOREIGN PATENT DOCUMENTS

| | | |
|---|---|---|
| 0355238 | 2/1990 | European Pat. Off. . |
| 2359469 | 2/1978 | France . |
| 2365844 | 4/1978 | France . |
| 2609341 | 7/1988 | France . |
| 2542363 | 3/1977 | Germany . |
| 3304549 | 11/1983 | Germany . |

*Primary Examiner*—F. J. Bartuska
*Attorney, Agent, or Firm*—Frishauf, Holtz, Goodman, Langer & Chick

[57] ABSTRACT

Apparatus for sorting and storing objects, such as coins, inserted by way of payment in a dispenser of products or services, of the type comprising a coin input unit connected to a selector adapted to sort the coins. The outlet of the selector is connected to a tray and to holder for the coins. The coins are directed either to the tray or to final storage box for the coins or to a removable recycling dispenser adapted to store the coins temporarily and to direct them either to the tray or to a cash box. The recycling dispenser includes at least two vertical tubes. A device is provided to prevent visual and physical access to the interior of the tubes when the latter are in position.

12 Claims, 13 Drawing Sheets

DEVICE FOR SORTING AND STORING OBJECTS INSERTED BY WAY OF PAYMENT IN A DISPENSER

FIELD OF THE INVENTION

The present invention is directed to apparatus adapted to allow objects to be sorted, and selectively discharged or stored. Such objects can be, for example, coins that are inserted by way of payment in a dispenser of goods or services. By way of illustrative example, the invention can be applied to dispensers for food products or for services in the form of a travel ticket or a parking ticket, issued to users in return for payment.

BACKGROUND OF THE INVENTION

By definition, dispensers of this type are located in public places where they are liable to be subjected to acts of vandalism by those intent on stealing the cash stored in the dispensers, having regard to the relatively large sums of money which they contain. Dispensers are generally designed to resist such acts of vandalism, by their mechanical design and by the materials employed. This results in an overall structure which is of relatively imposing size and weight.

Apart from external attacks, in the form of acts of vandalism referred to above, such dispensers are also open to fraud, e.g., seeking to obtain the products or services for free, without inserting money and, instead, either temporarily blocking the apparatus from dropping coins inserted by a legitimate user or temporarily preventing the product from being dispensed, or by inserting counterfeit coins or objects which are adapted nevertheless to actuate the mechanism for delivery of the corresponding goods or services. Specific means are employed to thwart or try to thwart these maneuvers, particularly by fitting dispensers with systems for detecting counterfeit money or non-conforming objects and/or with means for protecting the central unit controlling the operating system of the dispenser.

Nevertheless, cases occur in which these fraudulent maneuvers effected from outside the dispenser allow triggering of the central unit under exceptional circumstances, leading to partial or total emptying of the coins contained in the dispenser, into the tray, accessible from the outside, where return of change is effected. In addition, exceptional circumstances, such as lightning for example, can possibly cause malfunctioning of the central unit, which then triggers return of money, emptying the dispenser completely. It is clear that such actions are financially extremely prejudicial to the operator.

Apart from attacks which can be inflicted on dispensers from the outside, the latter can also be subjected to fraudulent acts on the part of persons having access to the interior of the dispenser for maintenance or repair operations. These fraudulent acts are more difficult to avoid since the majority of known dispensers are designed in such a way that part or all of the money stored in the dispenser is exposed to the view of the maintenance or repair personnel, with the attendant risk of temptation. The risk is moreover higher in that the means provided to prevent physical access to the coins contained in the apparatus are more or less non-existent or are extremely rudimentary and relatively easy to circumvent. In particular, known dispensers allow access to the coins contained in the temporary coin storage means during the removal of these means in order to effect maintenance or repair operations. Even though the fraudulent act only affects some coins in the dispenser, it results in a non-negligible loss for the operator. Attempts have been made in known manner to deal with this by providing dispensers with extremely complex means which increase size, weight and above all cost, thereby reducing any benefit which results from the reduction in fraud.

It is, thus, important that the coins contained in the dispenser should not be visible and, more importantly, not accessible to personnel charged with maintenance and repairs, while they are performing operations of removing different parts contained in the dispenser. Known dispensers do not resolve this difficulty in a satisfactory way. In addition, known dispensers suffer from major inconveniences in terms of operation, whether from the point of view of the user or the operator. In this respect it will be useful to recall general operating principles of dispensers, especially of the means for handling the inserted coins.

A first type of known device has, in succession, a coin input unit for effecting pre-recognition of the inserted object. Its outlet is connected to a selector which sorts by value the coins recognized as such. The outlet of the selector is connected to a first channel leading to a tray opening outside the apparatus and to a second channel connected to a holding means, called pre-collection means. At the outlet of the selector, the coin is directed to the tray when the coin is not recognized as conforming, or the coin is directed to the pre-collection means when it is recognized as conforming. The pre-collection means is adapted to direct the coins either to the tray, on cancellation by the user, or to the permanent storage means (cash box) for coins, when a product or service has been issued to the user.

That known device is relatively rudimentary and, thus, has little in the way of operating facilities, in particular in the sense that it does not give any change. The user, therefore, has to have the exact sum corresponding to the dispensed product or service. This leads to a major limitation for the user and thus reduces the possibilities for application of this device.

A second type of dispenser is known which is adapted to give change without recycling the coins. That type of device is similar to the first type of device described above, except for the fact that it further comprises storage means in the form of a reserve of coins for giving change and opening into the tray via a change channel.

Although it increases the number of possible uses of dispensers, that second type of known device also suffers from a major disadvantage in that it requires the reserve to be filled up, which implies a large capital outlay. This refilling requires recourse to labor, which increases the cost of operating the apparatus and also increases the risk of fraud during the refilling of the reserve. In addition, within the operating schedule, the reserve is generally exhausted relatively rapidly, unless there is frequent refilling and/or a reserve of large capacity, which only aggravate the problems mentioned above.

A third type of known device, adapted to give change, has been designed with means allowing coins to be recycled. That third type of device comprises substantially the same components as the second type without recycling, with the exception that the holding stack (or a routing means) is adapted to direct the inserted coins either to the tray, to the cash box or to the temporary change storage means, these being called recycling dispensers and being adapted themselves to direct the inserted coins either to the cash box or to the tray with the aid of routing means.

The coins directed to the cash box at the outlet of the holding stack are those which are not suitable for recycling, for example the coins of higher value. Coins are also directed from the holding stack to the cash box when the recycling dispenser is full.

The recycling dispenser includes components for temporary storage of coins, classified by value. Recycling dispensers exist with a hopper outlet provided with an aperture at its bottom, facing which is a disk with recesses in the plane of the disk adapted to receive the said coins, which are thus removed. This has the disadvantage that the disk has to be changed with every change in coin type.

There also exist dispensers formed by an endless chain provided with individual recesses in each of which one coin is placed. That known type is relatively bulky. Such a dispenser is available from Coin Controls Limited of Royton, Oldham, United Kingdom under the name Universal Hopper.

Recycling dispensers are known comprising a series of vertical tubes in each of which one type of coin is disposed, or else a series of coaxially-aligned carrousels on an axis parallel to or perpendicular to the feed direction of the coins. The most common carrousel type is that in which the carrousels are located about a common vertical axis. Although that type of dispenser having a carrousel is advantageous in certain respects, it nevertheless has the major disadvantage of being complex and bulky, since the different carrousels are superimposed on one another and the more so with the addition of a supplementary carrousel, required for example because of the creation of a new type of coin, thereby increasing the total height of the change channel.

Recycling dispensers of known type with vertical tubes or carrousels have in common the disadvantage of allowing direct and unprotected visual and physical access to the change stored in the dispenser. Removal of the recycling dispenser and its various parts thus gives direct access to the stored change, with the resultant possibility of fraud.

Another problem with known recycling dispensers is related to the return of change in the case of overpayment by the user through insertion of a relatively large number of coins of small value (10 centimes for example), then finishing with a coin of high value (for example 10 francs), the user having realized that he does not have the full amount in 10 centime coins. It is necessary to give change to the user and the optimum solution consists in firstly giving back the user his own coins.

In this respect, it should be noted that the idea of giving change to a user relies on an important principle, namely that the change given to the user should consist mainly if not completely of the user's own coins, as far as is possible. This follows from a double objective. The first objective is to give the user his own coins back when his command is cancelled at the last moment. The second objective is to avoid storing counterfeit coins possibly inserted by a defrauder and giving the latter authentic coins over and above the product or service for the value in question. This would amount to the defrauder "laundering" the counterfeit money, with obvious resultant financial consequences for the operator. By way of example, consider a travel ticket of value one dollar and assume that the defrauder inserts $0.75 in counterfeit coins and an authentic $10 bill to complete the operation. If known devices are not able to detect the counterfeit money, they issue a ticket for one dollar and return an amount of $9 to the defrauder. In all the defrauder would have the benefit of a one dollar ticket acquired for $0.75 in counterfeit coins and $0.25 in authentic coins.

The above example will be taken up again, namely of a user having inserted a large number of 10 cent coins and then, realizing that he does not have the total amount, inserting a coin or bill of high value. The recycling dispenser with vertical tubes does not allow coins of small value, for example 10 cents, to be stored. The coins are then stored directly in the cash box and the apparatus returns coins of low or medium value, such as 50 cents, for example. This is a nuisance to the operator, who is left with a large sum of money in numerous coins of small value, and has been deprived of coins of medium value for returning change.

Recycling dispensers with carrousels, of known type, allow coins of small value, 10 cents for example, to be stored. However, this possibility is provided at the expense of much complexity and increased size, since it is necessary to add an extra carrousel to those which exist and are each intended to receive a different coin.

Moreover, and apart from the problems mentioned above, dispensers are subject to particular specifications, especially as to operating schedule. It is desirable for the number of coins which can be stored to be relatively large, in order to allow return of change to the user under better conditions and without having recourse to frequent and thus costly re-stocking, and in order to avoid user dissatisfaction and/or financial loss for the operator because of the lack of use resulting with an apparatus which cannot return change.

It is also important that the persons charged with maintenance or repairs shall be able to gain access to the mechanism, without having to dismantle the dispenser completely, which would increase the resultant labor costs of such maintenance and/or repair operations. Furthermore, users are generally sensitive to the speed of operation of an apparatus and waiting time should be reduced to a minimum. For the reasons given above, it is equally necessary for the dispenser to be able to give change over the maximum range of coins. Likewise, the range of accepted coins should be as large as possible to satisfy the users. Finally, changes in tariffs, introduction of new products or services or the introduction of new coins, oblige manufacturers and operators to modify and/or adapt existing dispensers to allow them to operate under new conditions. This can lead to great difficulties in operating schedule when the amount of a transaction is such that it becomes necessary to increase capacity for return of change (for example a fare which is a few cents below or above a round sum, say $2.90 or $5.10).

SUMMARY OF THE INVENTION

An object of the present invention is to provide an apparatus capable of ensuring sorting and storage of coins inserted in a dispenser and adapted to effect pre-recognition, the coins being sorted and fed to temporary storage means or to final storage means or to a tray for giving change, depending on the operating requirements of the dispenser, and to do this under conditions seeking to overcome the problems referred to above.

Another object of the invention is to provide such an apparatus which does not allow visual or physical access to the coins during removal of various parts forming the dispenser, with a view to eliminating or at least reducing the possibility of fraud.

A further object of the invention is to provide an apparatus allowing the return of change with recycling of the latter, with a change-giving threshold that is as low as possible, ensuring the return of coins which have been inserted by the user, in order to avoid any operation seeking to "launder" counterfeit money.

Still another object of the invention is to avoid accidental or fraudulent setting of the dispenser into a condition in which the reserve of coins will be completely emptied into the tray.

Yet another object of the invention is to provide an apparatus capable of accepting a wide range of coins and which is also modular, in such a manner that it can readily accept modifications and adaptations to the system for conveying money when there is a fare change, the introduction of new coins to the market, or other modifications, and can do this without detriment to the capacity of the dispenser or to its size.

One other object of the invention is to provide a dispenser capable of storing a large number of recycled coins, for example up to 2,400, while also ensuring recycling of many coin types, for example up to six different types, and simultaneously preserving a measure of simplicity in the design, operation and accessibility of the various parts, for effecting maintenance and/or repair operations.

To this end, according to the invention, the apparatus for sorting and storing objects, such as coins, inserted by way of payment in a dispenser of products or services, is of the type comprising a coin input unit connected to a selector adapted to sort the objects, the exit of the selector being connected to a tray and to holding means (holding stack) for the same. The objects can be directed from the holding means either to the tray or to final storage means (cash box) for the objects or to a removable recycling dispenser adapted to store the objects temporarily and to direct them either to the tray or to the cash box. The recycling dispenser comprises at least two vertical tubes. Means are provided to prevent visual and physical access to the interior of the tubes when the latter are installed in the apparatus.

More particularly, the apparatus includes emptying means adapted to direct the objects (coins) contained in the tube (which is to be removed) to the cash box. Thus, removal of a tube is only possible when the latter is empty, which avoids any fraudulent act.

The apparatus advantageously includes means adapted to allow removal of only one tube at a time.

The holding stack preferably includes a rotary barrel in which the objects are adapted to be held while waiting, and the tubes are disposed in a circle centered on the barrel.

In a preferred embodiment, the holding stack also includes a plate on which the barrel is fixed, the plate being adapted to be covered by a casing and the plate being located at the top of a cash container containing the recycling dispenser. This, thus, prevents access to any part of the coin feed.

The apparatus preferably includes means allowing the barrel of the holding stack to empty during removal and access to the barrel, for example by raising the casing.

The apparatus advantageously includes routing means at the outlet of the recycling dispenser and comprising a hopper provided at its bottom with an aperture opening into two channels, connected respectively to the tray and to the cash box. The routing means comprises a flap adapted to block one of the channels alternately, under the control of actuating means, in such a manner that the flap closes the access to the tray when in its normal position, (the access channel to the cash box being open), independently of the electrical state of the change channel.

The apparatus also advantageously includes means for directing coins from the tubes one by one and comprising a sliding pusher associated with a cam actuated by a motor, all being integral with the tube.

In a preferred manner, each tube can be moved radially between a first position in which removal is blocked and a second position, offset radially towards the interior of the circle formed by the tubes. In the second position, a means is adapted to allow removal of one tube at a time, such means comprising a drum provided with an axial groove complementary in shape to the tube to be removed and adapted to receive the latter at least partially.

The means for automatically emptying the tubes during removal comprise a lug located on the pusher and adapted to enter a groove provided in the fixed base relative to which move the tube, the pusher and an associated motor, in such a manner that when the tube is in position ready for removal, i.e. when it is offset radially towards the axis of rotation of the drum, the lug on the pusher will be in abutment with the end shoulder of the groove in the base and will keep the pusher in the tube open position. This enables the base of the tube to be coupled to the aperture for total evacuation of the coins held in the tube, which are then fed to the cash box, the routing means then being in a position such that access to the tray is blocked. It will be understood that the removed tube is thus necessarily empty.

BRIEF DESCRIPTION OF THE DRAWINGS

The objects and features of the invention will be better understood in the light of the following description of an illustrative, non-limiting example of the invention, and with reference to the accompanying drawings, in which.

DETAILED DESCRIPTION OF THE PREFERRED EMBODIMENTS

Figure 1:
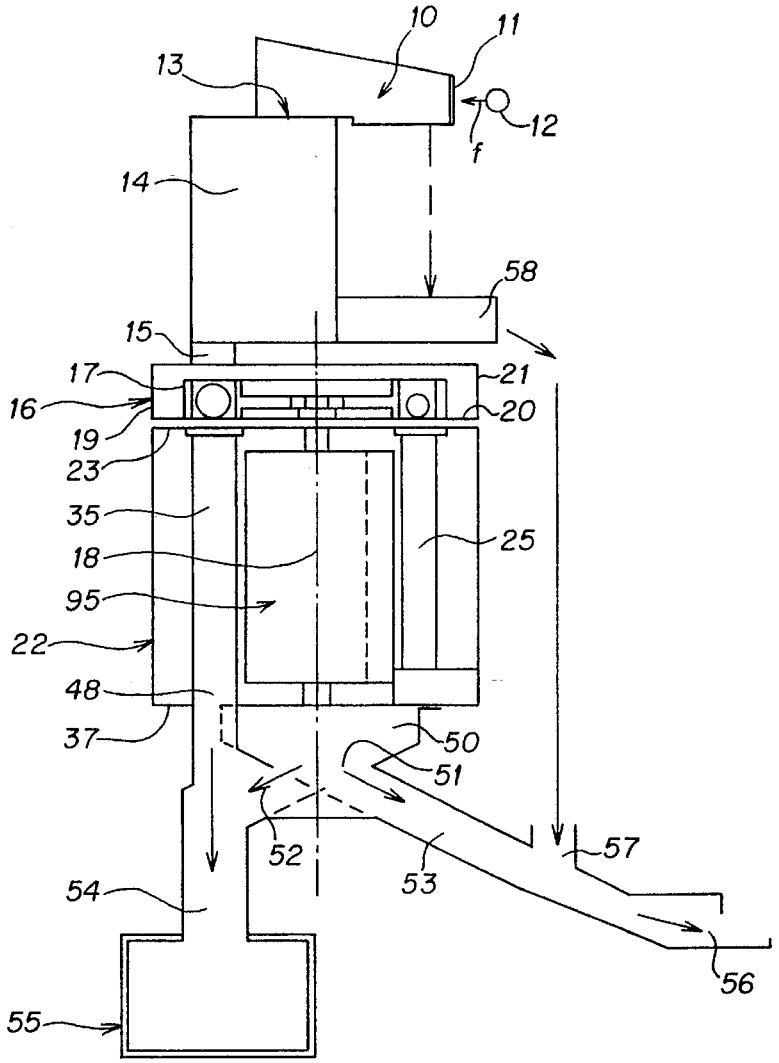
FIG. 1 shows the various elements of the device of the invention in a schematic manner, in a side view.

As shown in FIG. 1, the device of the invention comprises in succession a coin input unit 10 with a slot 11 for receiving an inserted coin 12 (arrow f). The coin input unit 10 includes well known means for identifying the inserted object in order to allow non-conforming objects to be eliminated. The coin input unit is preferably made to the design described in U.S. patent application Ser. No. 08/191,817 filed Feb. 4, 1994 now U.S. Pat. No. 5,429,222. A coin selector to determine the value or denomination, of the coin is available from Coin Controls Limited as model CS 3000, and another is available from Comestero of Milan, Italy, under the name NRI G-26.4000.

The coin input unit 10 has an outlet 13 opening into a coin selector 14, known per se and not shown in detail, with the main role of sorting the inserted coins according to type and of feeding them by way of a neck 15 to means for holding them in waiting, called the "holding stack". The holding stack 16 includes a barrel 17 mounted to rotate about a vertical axis 18 and located inside a casing 19 comprising a plate 20 and a cap 21. The plate 20 is preferably of generally square shape and the cap 21 is a rectangular block with a square base.

Figure 5:
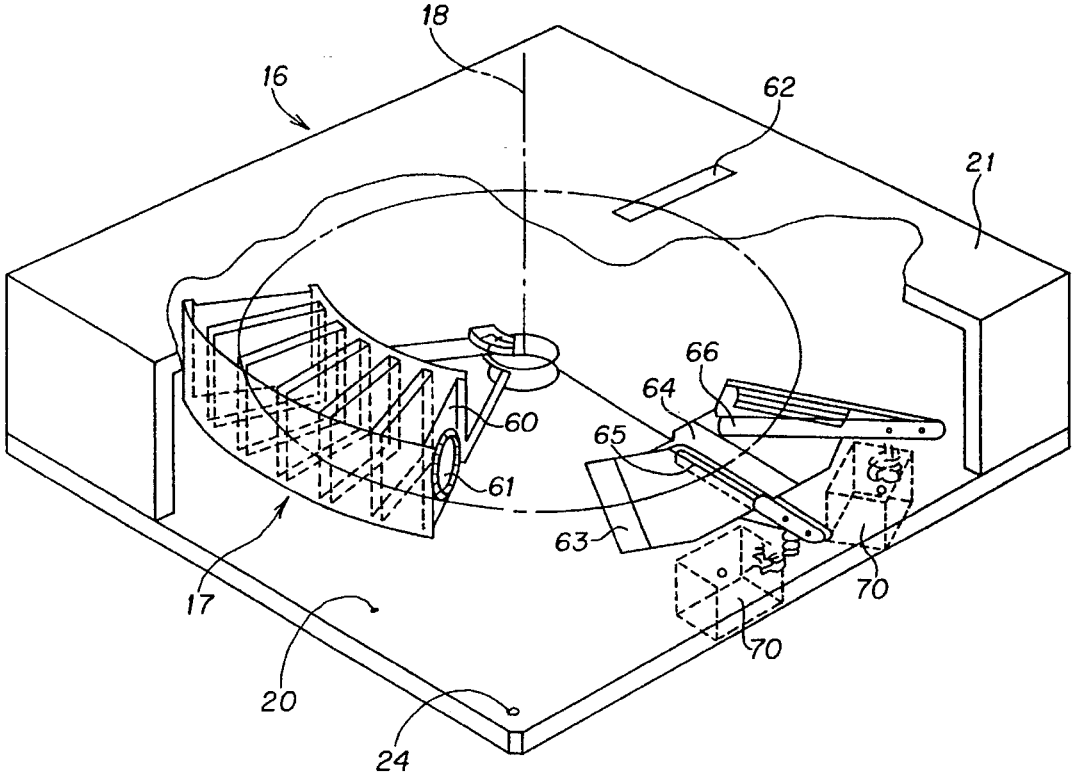
FIG. 5 is a perspective view of the casing, partially broken away, showing the inside of the latter and the holding stack barrel and the means for emptying coins.

The casing enclosing the holding stack 16, forming a rectangular block as is best shown in FIG. 5, is located at the top of cash container 22 formed as a rectangular block, the base of which is square and of a size substantially equal to that of the plate 20 of the holding stack 16. The cash container 22 is centered, as is the holding stack 16, on the axis of rotation 18. The plate 20 of the holding stack 16 is fixed with four screws (not shown) on the upper wall 23 of the cash container 22 at attachment points 24 (FIG. 5). Cap 21 is kept in place on plate 20 by a mechanism on its central axis, the details of which are conventional and, therefore, not deemed necessary.

Figure 2:
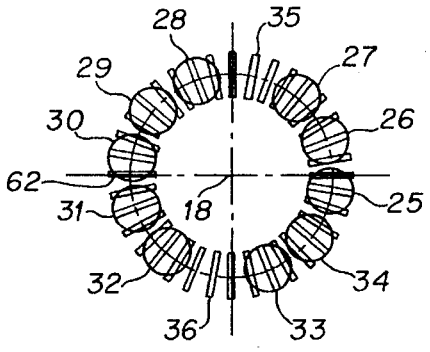
FIG. 2 is a schematic top view of the respective positions of the holding stack and of the dispensing/recycling tubes.
Figure 3:
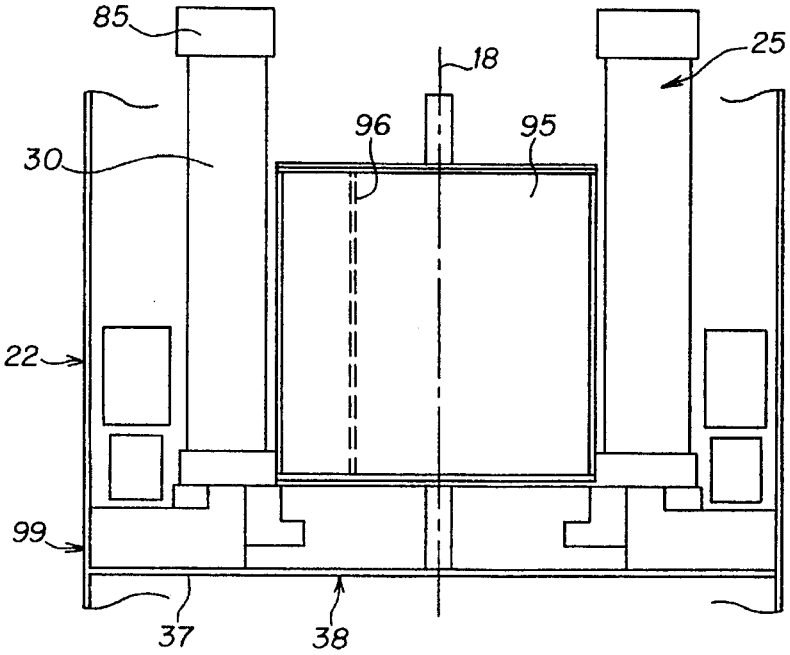
FIG. 3 and FIG. 4 show the tubes disposed inside the cash container and the central drum blocking the tubes, in a side view and in a top view, respectively.
Figure 4:
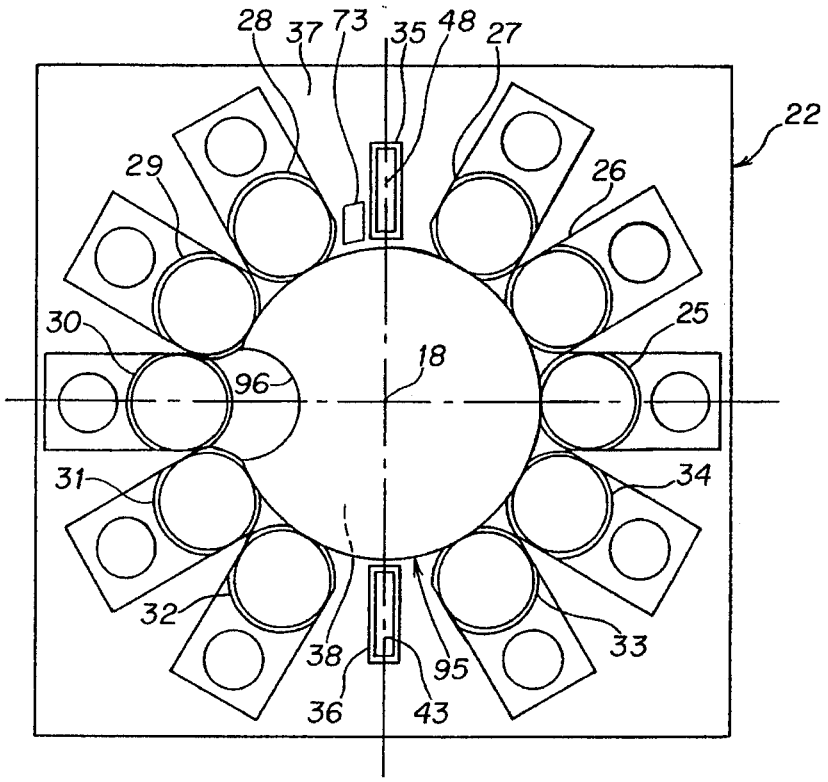

The cash container 22 comprises a series of vertical tubes, each adapted to receive coins of a single type, and forming what it is convenient to call the recycling dispenser. The tubes, with the references 25 to 34, are disposed in a circle centered on the axis of rotation 18 of the barrel 17 of the holding stack 16, as shown in FIGS. 2 and 5. Only the tube 25 is shown in FIG. 1, it being understood that the device can include at least two tubes and up to ten tubes for example. Note that, in the example of ten tubes shown, the latter are grouped in two groups of five, leaving spaces in the form of annular sectors between the circularly arcuate groups, as shown in FIGS. 2 and 4 for example. Two chutes 35 and 36 respectively are located in the two free sectors between two facing tubes of the two respective groups of five, having a length equivalent to that of the tubes and of a rectangular section substantially equivalent to but slightly greater than the size in section of the largest of the acceptable coins. The base 37 (FIG. 3) of the cash container 22 is provided with a circular aperture 38. The aperture 38 is centered on the axis of rotation 18 and is located under tubes 25–34. The base 37 of the cash container 22 also comprises a second series of two apertures 43 and 48 of rectangular shape and of dimensions slightly greater than the diameter of the largest acceptable coins.

Inside the circle formed by the tubes 25 to 34 there is a drum 95 of a diameter such that it is tangential to but slightly set back towards the axis 18 from the set of tubes 25 to 34 of the recycling dispenser. The drum 95 is mounted to rotate about the axis of rotation 18 and has an axial groove generally of semi-circular shape and of such a size that the groove can receive a tube, at least in part. In the example shown, the axial groove 96 is of such size that it will receive half of a tube. The latter is thus offset relative to the other tubes toward the axis of rotation 18.

The aperture 38 opens into a hopper 50 the bottom of which opens into two ducts 52 and 53. The duct 52 opens into a duct 54 leading to the final storage coin means, hereinafter called cash box 55. The other duct 53 leaving hopper 50 opens into a tray 56 for returning change and emptying objects to the outside of the apparatus, for return to the user. Note that duct 54 and duct 52 are continued upward to the base 37 of the box 22 opposite to aperture 48 (FIGS. 1 and 4), which itself is an extension of chute 35. Likewise, the aperture 43 is an extension of chute 36 which is connected to the duct 53.

The tray 56 is also connected by an aperture opening into the second duct 53 (also opening into the hopper 50) to a duct 57 connected to an emptying channel 58 opening at the base of the selector 14 for emptying objects, especially coins, inserted by the user and returned because they do not conform, in which case the service or the product is not dispensed and the money inserted by the user has to be returned via the tray 56. Note also that the coin input unit 10 in accordance with the French patent application cited above is also connected to the emptying channel 58, in order to allow emptying and return to the user of objects judged not to conform in the case of the pre-recognition operations effected by the coin input unit 10, in a known manner.

The holding stack 16 is described below in more detail with reference to FIG. 5. The barrel 17 is formed by a part of toroidal shape of substantially square section and comprising a series of generally rectangular recesses located in the plane of the axis of rotation 18 of the barrel 17, such as the recess 60 a part of which is shown and with a coin 61 inside it. The barrel 17 can contain 36 coins in 36 corresponding recesses.

Rotation of barrel 17 is effected by a control means (not shown) using optical encoding. This is well known and, therefore, details thereof are not deemed necessary. The coins are fed to the inside of the corresponding recesses 60 of the barrel 17 by way of a slot 62 provided in the upper face of the cap 21 and in line with the duct 15 connecting the coin selector 14 (FIG. 1) and the holding stack 16. The slot 62 has a shape and dimensions complementary to those of the cross-section of the recesses 60 in a plane perpendicular to the axis of rotation 18 and also in a plane perpendicular to the longitudinal feed direction of the coins from the selector 14 to the holding stack 16. The coins 61 rest and slide on the plate 20 of the holding stack 16 over slide sectors (only two sectors 63 and 64 being shown for reasons of clarity). Each sector has an associated trapdoor 65, generally of a form allowing the coin in the recess facing the trapdoor to be emptied vertically downward. A tube of the recycling dispenser is associated with each trapdoor, so that each trapdoor is located opposite a tube the diameter of which, in a radial direction, is parallel to the plane of the plate 20 such that a coin leaving the recess 60 passes through the corresponding trapdoor and arrives in the corresponding tube (25 to 34). The plate 20 thus comprises a first set of trapdoors, each corresponding to a tube, namely a total of ten trapdoors in the example shown, and a second set of two trapdoors, of which one is for emptying coins through the chute 35 to the cash box and the other trapdoor is for direct emptying of coins from the holding stack 16 to the tray 56, via the hopper 50.

The coins leaving the coin selector 14 and which are not emptied through the emptying channel 58 to the tray are fed via the duct 15 to the holding stack 16 through the slot 62 and pass into the corresponding recesses 60. As each coin drops into a recess 60, the number of the recess receiving such coin is recorded along with the type of such coin. At the end of the payment phase the coins are thus all lined up in the barrel 17. After dispensing the product or service, the barrel is rotated by its control means which is connected to the central unit of the dispenser, and is advanced until the corresponding recess containing a coin of known, particular value comes into line with a corresponding trapdoor for a particular tube for this type of coins, and actuating means described below allow the normally closed trapdoor to open, in order to allow the coin to empty out into the corresponding tube, or into the emptying chute 35 leading to the cash box 55 or to empty through a chute to the tray 56 via the hopper 50.

The central unit of the dispenser includes a suitably programmed central processing unit ("CPU") preferably utilizing a microprocessor and associated circuitry- The microprocessor can be model no. 68HC11 available from Motorola. Details of the complete circuitry and the program for the CPU will be readily apparent to anyone with ordinary skill in the art from the disclosure of the invention set forth herein.

Referring to FIG. 5, the actuating means for closing and opening the trapdoors 65 are formed by arms 66 swinging between a trapdoor closed position and a retracted position in which the trapdoor is opened. The transition from one to the other of the positions is effected under the action of an electromagnet 70 which is controlled, for example, by the central unit. Thus, for each tube there is a corresponding slide sector, a trapdoor, a closing/opening arm for the trapdoor and an electromagnet. FIG. 5 only shows a portion of each of these parts. The apparatus of the invention actually comprises ten tubes, two ducts, twelve sectors, twelve trapdoors and twelve electromagnets, as is shown in the other figures.

Figure 6:
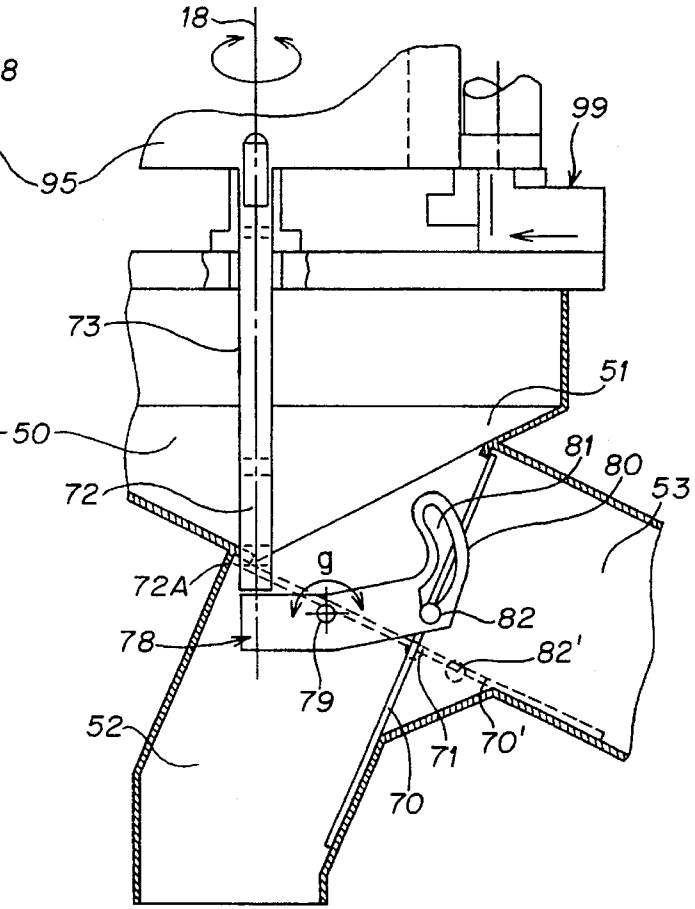
FIG. 6 is a partial side view, to a larger scale than FIG. 1, of the routing means located at the base of the recycling dispenser.
Figure 7:
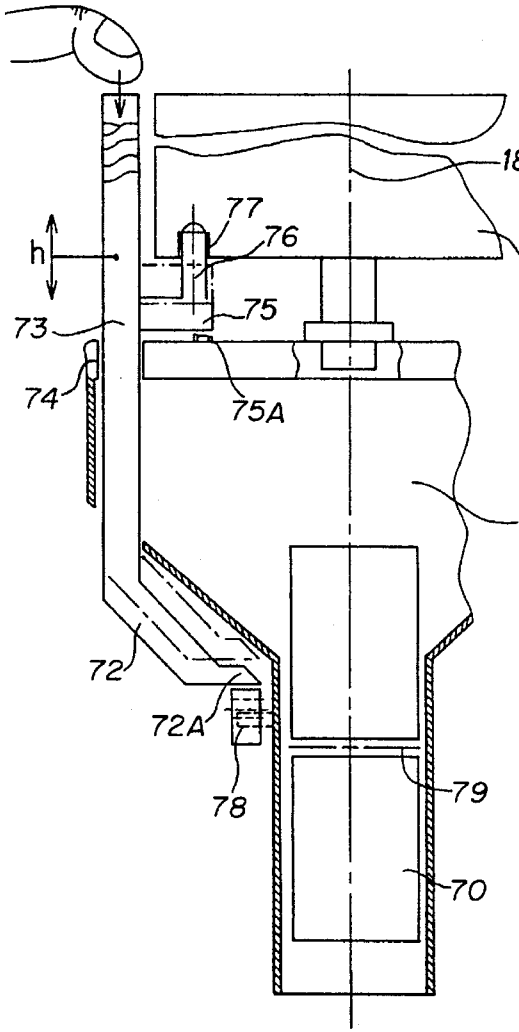
FIG. 7 is a front view of the device of FIG. 6.

The routing means and the hopper 50 are adapted to direct the coins to the output of the recycling dispenser (tubes 25 to 34), or towards the tray 56 via the duct 53, or toward the cash box 55 via the duct 52 (the 54, FIG. 1), and are described below in detail with reference to FIGS. 6 and 7.

The lower part of the hopper 50 is provided with an aperture 51 opening into one or the other of the ducts 53 and 52. A blocking flap 70 is mounted to rotate about an axis 71 transverse to the axis of rotation 18 corresponding to the vertical feed direction of the coins. The flap 70 moves between a first position in which it blocks the duct 53 leading to the tray, the duct 52 leading to the cash box then being open, and a second position in which the flap 70 blocks the duct 52 (leading to the cash box 55) and thus leaves clear the access to the duct 53 leading to the tray 56.

Passage from one to the other of the positions of the flap 70 is effected by means of a mechanism described below.

A rocker 78 is mounted on the outside of the hopper 50 so as to pivot about an axis of rotation parallel to the axis of rotation 71 of the flap 70. One end of the rocker is provided with an opening 81 adapted to cooperate with a lug 82 integral with the flap. The opening 81 has a shape such that the flap can assume two positions in which the lug 82 is at one or the other of the two ends of the elongated profile of the opening 81. In a first position shown in full lines in FIG. 6, the flap 70 blocks the duct 53 leading to the tray and, thus, the flap is in a position such that any coin falling into the hopper 50 is directed into the cash box 55 The second position 70', shown in broken lines, with the lug at position 82', corresponds to the second position of the flap in which the latter blocks the duct 52 leading to the cash box 55, so that any coin falling into the hopper 50 is then directed to the tray 56. The double arrow g shows the alternating rotary movement of the rocker 78 between the two extreme positions of the flap 70 and 70'. Rocker 78 is generally L-shaped, with the leg 80 being substantially perpendicular to the body. Elongated opening 81 is formed in leg 80.

The other end of the rocker 78, on the other side of the axis of rotation 79 is adapted to cooperate with the lower end of an arm 72 provided at the lower end of a vertical rod 73 adapted to move on a vertical axis. To this end, the rod 73 passes through an aperture 74 in the base 37 and extends above the latter. The double arrow h (FIG. 7) shows the two possible directions of movement of the rod 73, i.e. up or down. The rod 73 is provided on the part above the base 37 with an arm 75 extending at right angles to the direction of the vertical axis 18 of rotation of the drum 95. The remote end of the arm 75 has a lug 76, preferably cylindrical, and complementary in shape to a recess 77 in the drum 95. The remote end 72A of the arm 72 located at the lower end of the rod 72 is adapted to bear against the corresponding end of the rocker 78. The rod 73 is adapted to be translated to a position drawn in full lines in which the end 72A of the arm 72 bears against the end of the rocker 78 and thus causes rotation of the rocker 78 into the position shown in FIG. 6 in full lines, in which the flap 70 closes access to the tray and connects the hopper 50 to the duct 52 connected to the cash box 55.

The downward movement of the rod 73 is effected by the operator (a person who is in charge of maintenance) by pressing down with his finger (shown in FIG. 7) on the top thereof. With such movement of rod 73, the lug 76 leaves its recess 77 in the drum 95 and the latter can thus be caused to rotate, again by the operator so as to remove the tubes, as will be explained below. It is noted that the positioning of the flap 70 is effected manually, regardless of the electrical state of the circuit. It is also noted that the position of the lug 76 and its height are such that in any angular position of the drum 95, other than that in which the recess 77 is opposite the lug 76, the lug and thus the rod 73 are pushed down, since the lug bears on the base of the drum 95. A spring 75A is provided on the arm 75 in such a manner as to apply a restoring force to the arm 75 to retract it upwardly, in such a manner that the lug 76, arm 75 and rod 73 will be shifted up automatically as soon as the recess 77 is opposite the lug 76, in order to come into the position shown in chain-dotted lines in FIG. 7, in which the flap 70 is adapted to assume one or the other of its two main positions. This is extremely advantageous insofar as, regardless of the power supply and the electrical or electronic state of the apparatus and the control means, any coin entering the hopper 50 and which may emanate from the recycling dispenser or directly from the holding stack 16, is automatically emptied into the cash box 55. When rod 73 is shifted upwardly and releases rocker 78, a spring (not shown) causes rocker 78 to rotate to the position shown in FIG. 6 in broken lines.

Figure 8:
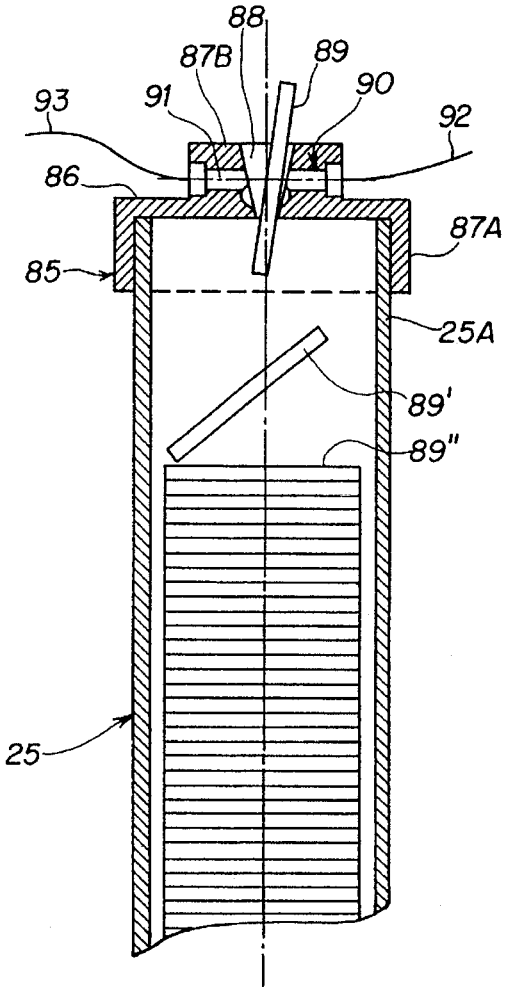
FIG. 8 is a longitudinal cross-section of the upper part of a tube.

The upper part of a tube, such as the tube 25 is shown in FIG. 8 in a detailed view in longitudinal section, being provided at its upper end 25A with a cap 85 comprising a disk 86 extended at its periphery by a collar 87A at right angles to the disk 86, the collar 87A being of such shape and dimensions that it can be attached to the upper end of the tube 25 and be fixed irremovably on the tube 25. The upper disk 86 is provided on its side opposite the tube 25 with a heavy part 87B having a through opening 88. The opening 88 is generally in the form of a slot with a trapezoidal cross-section, with dimensions such that the slot 88 allows passage of a coin 89. Coin 89 is shown in FIG. 8 in the course of passing through the opening 88, in a substantially vertical plane. Once the coin has passed through the opening 88 and enters into the tube 25 it assumes a position like the position 89' shown and then, as the coin continues its movement under gravity, it comes into place on the top of the stack of coins and assumes the position 89". Optical sensors 90 and 91 are located in the solid part 87B on one side and the other of the slot 88. An optical detector is formed by optical sensor 90 and light source 91 which are connected to the central unit in a manner known per se, by wires 92 and 93 respectively. The optical detector makes it possible to follow the passage of the coins coming from the holding stack 16 and entering each tube at all times.

Figure 9:
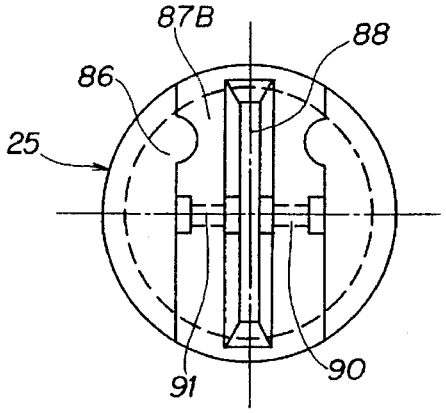
FIG. 9 is a top view of the cap located on the upper end of the tube of FIG. 8.

It is to be understood that each tube is provided with a cap such as the cap 85 shown in FIGS. 8 and 9. The trapezoidal shape in cross-section of opening 88 firstly facilitates the coin to fall properly, regardless of its original position when it leaves the holding stack 16 and secondly, on account of the narrowed part facing the interior of the tube, prevents any attempt to remove coins contained in the tube 25 in a fraudulent manner.

It will be understood that the preceding description of the device of the invention prevents the person responsible for maintenance and/or repair from seeing the coins in the assembly of the device and in particular in the holding stack or the recycling dispenser (tubes). Thus, with reference to FIG. 1, the casing 21 covers the plate 20 which is itself fixed on the upper wall 23 of the cash container 22 containing the recycling dispenser tubes. The base 37 of the cover 22 is itself inviolably connected to either the cash box 55 or the tray 56. Thus the assembly provided from the coin insertion slot 11 of the coin input unit 10 to the tray or the cash box is a compact assembly which does not reveal the coins or the amount of money which it contains. Apart from this visual barrier, the invention provides a mechanical barrier to prevent access to the coins contained in the various members of the device of the invention.

Access to the recycling dispenser comprising the tubes 25 to 34 is only possible when the holding stack 16 is removed. Access to the holding stack 16 itself is only possible when the cap 21 is first removed. In doing this the invention comprises means which effect complete emptying of the barrel 17 of the holding stack, so that any intervention in the holding stack can only be effected once the barrel is empty. The automatic emptying of the barrel 17 is effected regardless of the electrical or electronic state of the device. For example, a crank firstly causes the trapdoor connecting the barrel 17 to the cash box 55 to open and then causes the barrel to rotate, so as to place each coin receiving recess opposite the trapdoor facing the chute 35 connected directly to the cash box 55. Thus, any receptacle which may contain a coin is emptied and its contents go directly to the cash box 55, where they are by definition inaccessible. The cash box 55 is actually formed by an impregnable container and has a very high resistance to vandalism. Once the barrel 17 is empty, the cap 21 can be removed.

The security of the device is further reinforced to the extent that, when the person charged with the maintenance or making repairs needs to access the tubes, he has firstly to remove the cap 21, preceded by emptying of the barrel 17, and then release the plate 20 from the upper part 23 of the cash container 22 enclosing the recycling dispenser tubes. Once the plate 20 has been raised, the person still does not have access to the interior of the tubes, since these are integral with the base 37 of the cash container 22 (as explained below) and their upper part is blocked inviolably by the cap 85 (FIGS. 8 and 9).

Figure 10:
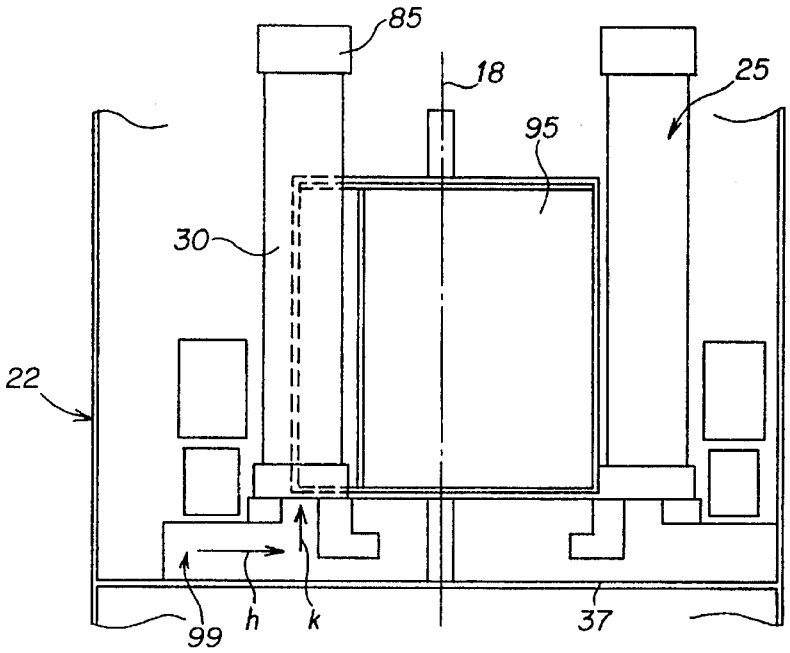
FIGS. 10 and 11 show the recycling dispenser of FIGS. 3 and 4, respectively, in a side view and in a top view, for a position offset radially toward the interior, of one of the tubes, ready to be removed.
Figure 11:
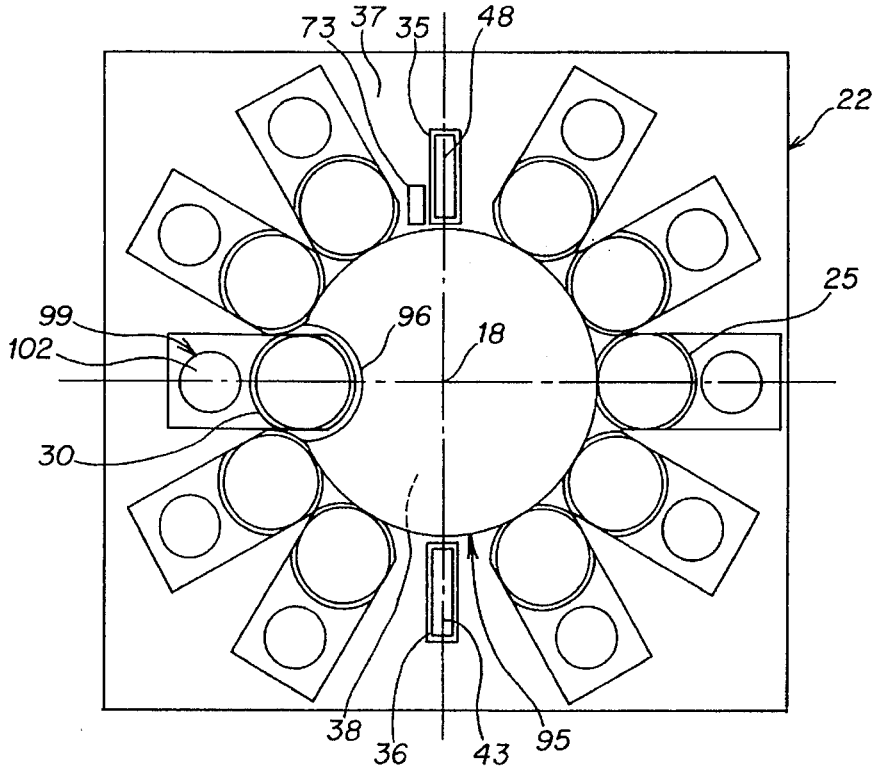

When it is necessary to remove one or more of the tubes, in order to allow repair of one of the tubes or of any part associated with its operation, the apparatus then only allows removal of one tube at a time, through the means described below with reference to FIGS. 10 and 11. FIGS. 10 and 11 are similar to FIGS. 3 and 4, with the exception that one of the tubes and the emptying means associated therewith (and described below) are offset, so that their axis moves in a plane perpendicular to the axis 18, toward the axis of rotation 18. The tubes are mounted on an assembly 99 adapted to slide on the base 37 of the cash container 22 holding the recycling dispenser tubes. The tubes are adapted to slide between a first position, such as that shown in FIGS. 2 and 4 for example, and a second position radially offset therefrom toward the interior of the drum 95.

Note that only one tube at a time can be shifted into its second, offset position, since the drum is tangent to the other tubes which cannot therefore be shifted towards the inside of the circle, since the drum physically blocks this. The arrow h in FIG. 10 symbolizes the movement in radial translation on the base 37 of the assembly 99 carrying the tube, while the vertical arrow k symbolizes the displacement of the tube and of the assembly 99 in a direction parallel to the axis 18 and with an upward movement to the open side of the cash container 22. The assembly 99 associated with each tube and disposed at its base is provided with mechanical means such as two lateral lugs 115, 116 (see FIG. 14 and the explanation provided below) located at the two sides of the assembly 99 and each adapted to slide in a complementary groove provided in the base 37 of the cash box 22. In the out of center position, each tube is rendered integral with the base 37 and thus with the cash container 22, through the engagement of the lateral lugs in the corresponding grooves. The lengths of the grooves and of the lugs is such that the movement in radial translation of the carrier assembly 99 of each tube through a given length, such as to reach the position of the tube 30 shown in FIG. 11, is sufficient to disengage the lugs from the corresponding grooves. In this position, the person charged with the maintenance can then grasp the tube by the top cap 85 and lift the tube and the assembly 99 by a simple upwards pull.

Extraction of another tube can only take place through rotation of the drum 95 by the operator, as described below, so as to place the axial groove 96 opposite the tube to be removed.

The invention makes it possible to ensure complete emptying of each tube, before it is taken out of the cash container 22. Thus, not only can only one tube be removed but the removed tube is empty. Emptying of each tube is effected into the cash box 55, without direct intervention of the person charged with the maintenance, as described below in detail with reference to FIGS. 12A, 12B and 12C, also showing the means for discharging coins one by one, relating to the operation of the apparatus in the course of returning change to the user. Furthermore the device comprises means adapted to prevent any attempts by picking to remove the coins from the tube in the offset position, before the tube is removed. These means are described with reference to FIGS. 16, 17 and 18.

Figure 12A:
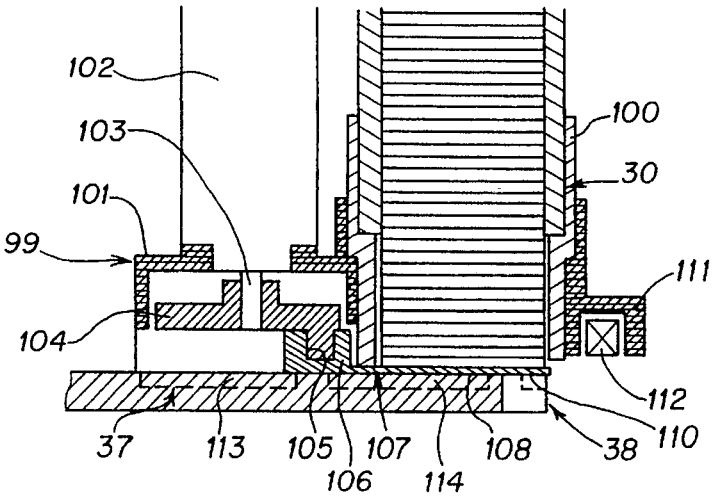
FIGS. 12A, 12B and 12C show the base of the tube and the coin emptying means, in the coin emptying position, in a longitudinal section view, in a view from above, and in a front view, respectively.
Figure 12B:
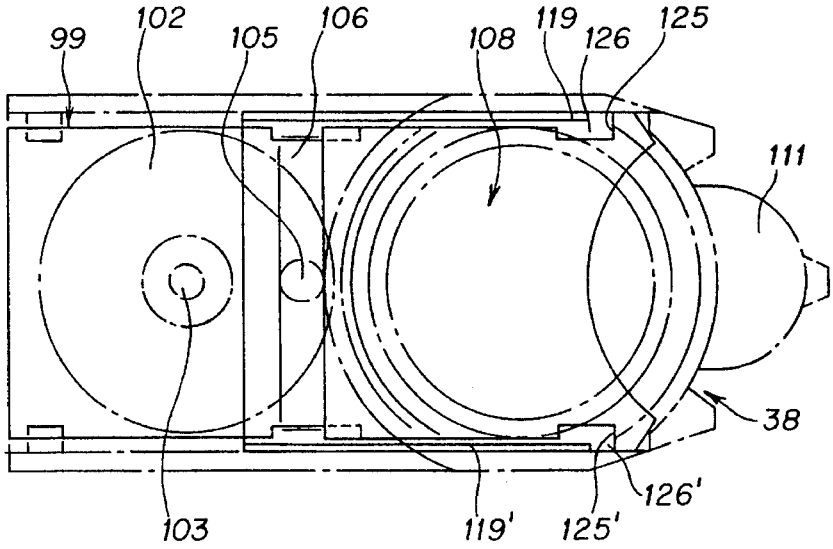
Figure 12C:
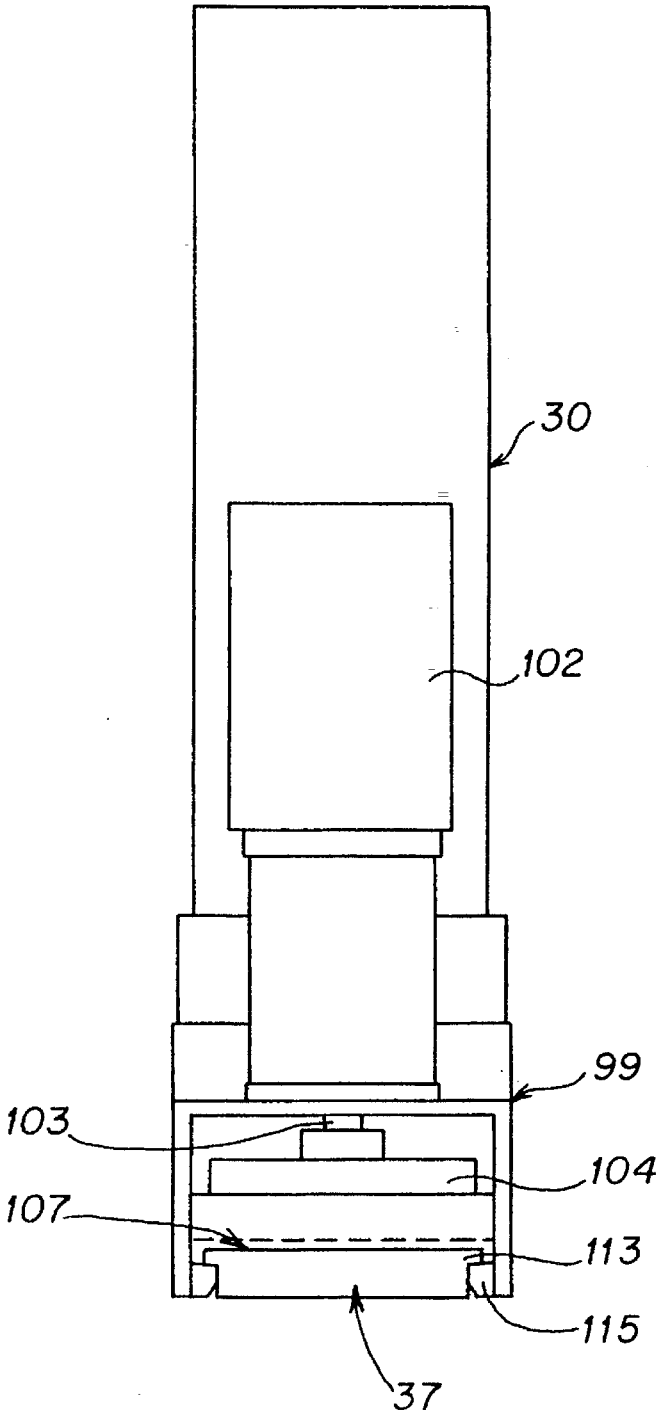

FIGS. 12A, 12B and 12C show the lower part of a tube and the associated assembly 99, in a position emptying the coins from the bottom of the tube.

The assembly located at the bottom of the tube 30 comprises firstly a sleeve 100 receiving the bottom of the tube 30 and secondly a box 101 on which there is an electric motor 102, whose shaft 103 is fixed to a cam 104 provided with a lug 105 adapted to be engaged in a corresponding recess provided in a part 106 of a slider 107. Slider 107 includes a tongue 108 adapted to slide on the surface of the base 37 in a space corresponding thereto in thickness and provided under the sleeve 100 in the position shown in FIG. 12A. The coins collected in the tube 30 are retained at the bottom of the sleeve 100 by the tongue 108 of the slider 107, which itself rests on the surface of the base 37 integral with the cash container 22. The end of the tongue 108 remote from the motor 102 and the cam is shaped according to an arc of a circle 110 (see FIG. 12B), of a shape complementary to the type of coins contained in the tube 30. The assembly 99 and the associated tube 30 are rendered integral with the base 37 by lateral lugs 115, 116 adapted to engage in grooves of complementary shape under projections 113 and 114, provided in the base 37. The lugs are shown in FIGS. 12C and 14. The lateral displacement of the assembly 99 and the associated tube 30 is made possible between a first position shown in FIG. 12A and a second position offset in the direction of the axis of rotation 18 of the drum 95, i.e. to the right in FIG. 12A, up to the position shown in FIGS. 11, 13A and 13B. On the opposite side of tube 30 from motor 102 and cam 104 there is on the outside of sleeve 100 an inverted Y-shaped part 111 of which the concavity is adapted to receive an inductive sensor 112. The latter projects from the tube 30 in a radial manner and faces the opening 43 provided in the base 37 for emptying coins.

Emptying coins one by one (during the return of change) is effected in the following manner. Commencing from the position shown in FIGS. 12A and 12B, the motor 102 is energized, which causes the cam 104 to rotate with movement to the left in FIG. 12A of the solid part 106 of the slider 107, which thus moves the tongue 108 to the left, until the coin at the bottom of the stack of coins 109 held in the tube 30 rests directly on the base 37. More specifically, in this position of the slider 107 offset to the left, the coin enters into the arcuate portion 110. Note that, in this position, the slider 107 and the coin at the bottom of the stack of coins are at the same level and both rest on the upper surface of the base 37. As rotary movement of the cam 104 continues beyond half a rotation, the slider 107 is moved back to the right, thus pushing the corresponding coin until it comes over the aperture 38 provided in the base 37. The coin then falls through the opening 49 into the hopper 50. The coin is then fed, depending on the position of the routing means flap 70, either to the tray 56 or to the cash box 55. During the translatory movement of the coin and just before it falls into the opening 43, the inductive sensor has been able to detect its passage so it can be recorded by the central unit. In this respect it should be noted that the assembly of the optical sensor 90/91 located at the upper part of the tube on the cap 85 and the inductive sensor 112 located at the bottom of the tube make it possible to provide the central unit with information at any time on the movement of the coins and on the contents of each tube which only contains one given type of coins.

The means allowing a tube to be emptied when the latter is ready to be raised or removed are described below with reference to FIGS. 13A and 13B. As indicated above, the tube (and the associated assembly 99) are adapted to be translated parallel to the base 37 (in a radial direction relative to the axis of rotation 18), the direction of translation being symbolized in FIG. 13A by the arrow i. They arrive in the position radially offset towards the axis of rotation 18, such as is shown for the tube 30 and the assembly 99 in FIG. 11.

The tube is then ready to be raised by pulling it up, parallel to the axis of rotation 18, as shown in FIG. 14. In this position, the lugs 115 and 116 associated with the grooves under projections 113 and 114 provided in the base 37 come opposite disengagement slots. Nothing then restrains the lugs 115 and 116 and, thus, the assembly 99 and the tube can be removed (arrow j).

The means are described below with reference to FIGS. 12A, 12B, 13A, 13B and 14 which allow the slider 107 to be pushed back (radially outwards), in such a manner that it frees the opening 38 through which the coins slip out of the tube, during the radially inward translation of the tube and associated parts, to bring it into the recess 96 of the drum 95. In this removal position of the tube (FIGS. 13A and 14 for example), the tube is above the opening 38 and nothing retains the coins any longer, since the slide is held in its most distant position in the radially outwards direction. In order to do this, referring especially to FIGS. 12B and 13B, it is seen that the slider 107 is provided with a projecting side rail with the reference 119, actually two side rails 119 and 119' located on one side and the other. The ends of the side rails 119 and 119' on the side of the axis 18 of the drum 95 are adapted to come into abutment with a shoulder 125 on the radially inner end of a recess 126 formed in the edge of the base 37, beside the aperture 38. In fact there are two recesses 126 and 126' respectively and two shoulders 125 and 125' respectively on the two sides of the tube and of the assembly 99 (FIG. 12B). In FIG. 12B, the slider for pushing the coins is in its position of maximum extension radially inwards. The tube and the assembly 99 are in the position of normal use.

Figure 13A:
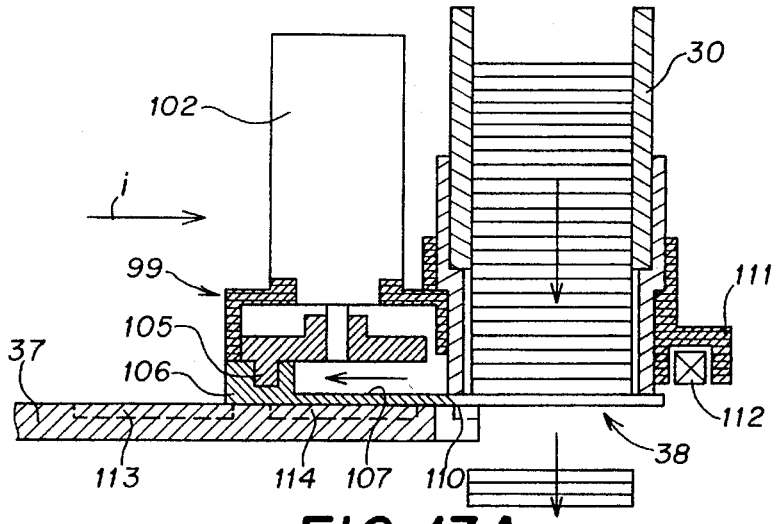
FIGS. 13A and 13B are similar to FIGS. 12A and 12B, respectively, but show a shifted position of the tube for its removal.
Figure 13B:
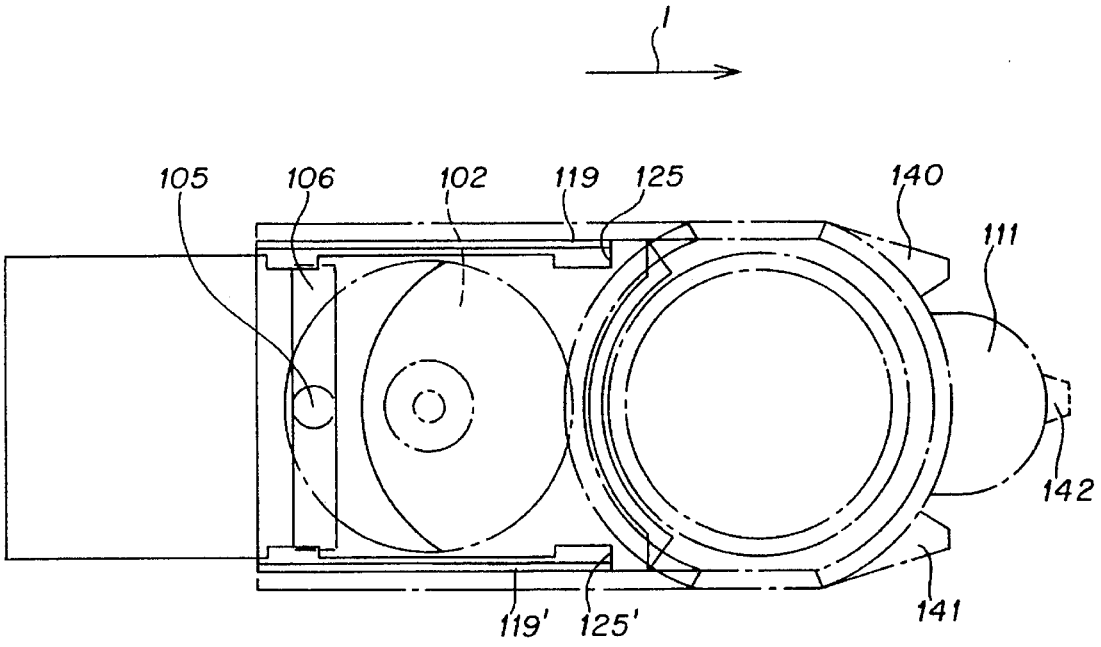

When it is desired to raise the tube (and the assembly 99), it is moved in the direction of the arrow in FIG. 13B and, in doing this, the parts 119, 119' come into abutment with the shoulders 125 and 125' which are fixed and prevent the slider from moving with the translatory movement of the tube and the unit 99. This keeps slider 107 in the position such as is shown in FIG. 13B, in which the slider is not a barrier to aperture 38, which allows the coins to empty out.

Referring again to FIGS. 6 and 7, when the operator has removed the holding stack and, with a view to gaining access to one of the tubes, he has to turn the drum 95 in such a manner that the longitudinal or axial channel 96 provided in the said drum will be opposite a tube, so as to be able to translate this tube towards the channel and thus allow it to be taken out. However, the rotation of the drum is not possible when the lug 76 (FIG. 7) is located in the recess 77 provided in the drum 95. In order to disengage the drum and allow it to rotate, the operator firstly pushes the rod 73 down so that it passes from the position in chain-dotted lines into its position in full lines (FIG. 7), which enables the lug 76 to disengage from the recess 77, so that the drum can be rotated by the user so as to position the longitudinal channel 96 opposite the tube which is to be removed. Once the channel is facing the tube, the tube and its assembly 99 are translated radially towards the axis 18, in the manner previously described. Note that, as has been described above with reference to FIGS. 6 and 7 the downwards movement of the rod 73 places the flap in such a position that it blocks the duct 53 leading to the tray, thus forcing all the coins coming out of the hopper 50, i.e. leaving the tubes in the course of their removal, to pass into the duct 52 leading to the cash box.

Figure 14:
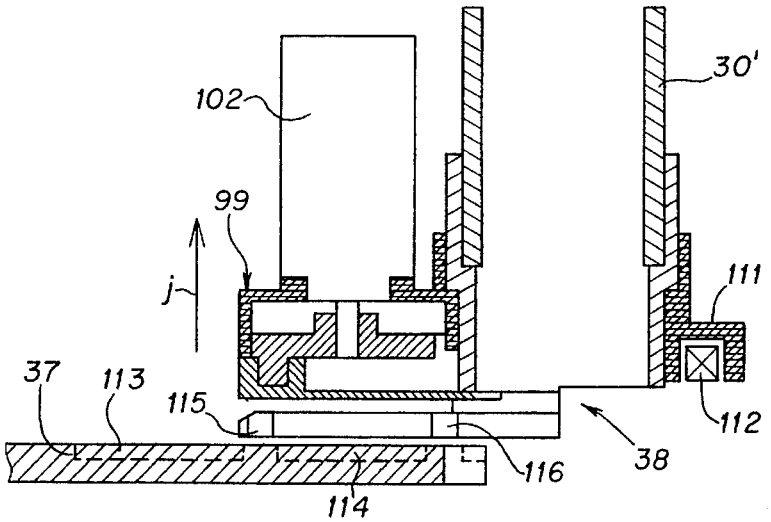
FIG. 14 shows the tube in removed position.

Reverting to FIG. 13A, the coins falling through the aperture 38 pass into the hopper 50 and are then fed by the ducts 52 and 54 to the cash box 55.

It will be understood that the movement of the tube from its out of center, blocked position into the position offset radially towards the interior causes movement of the slider, as has been described previously with reference to FIGS. 13A and 13B, which frees the passage for the set of coins in the tube and which are fed to the cash box 55 with complete security. At this time the tube is empty and the person charged with maintenance can free the tube, which is completely empty of coins, by pulling it up.

Note that the operation of the apparatus as has been described above is effected regardless of the electric or electronic state of the system, even if there is an interruption in power.

The apparatus of the invention also forms a kind of mechanical memory, allowing the removal of the tubes to be detected, since the slider 107 is necessarily shifted into a given position when the tube is translated with a view to its removal. The tube cannot be remounted if the slider is not in the position opening the aperture 38.

The apparatus of the invention also comprises means enabling the drum to be put into the correct position during disassembly and especially during lifting the casing 19 of the holding stack. The drum 95 has a lug (not shown) in its upper part, adapted to cooperate with a complementary recess (not shown) in the plate 20 of the holding stack 16, (more precisely on the face of the plate facing the drum), the respective positions of the upper lug of the drum and of the recess in the plate being such that it is only possible for the operator to replace the plate 20 in its correct position when the lug on the upper part of the drum 95 is opposite the corresponding recess. However, in returning the drum 95 to its position (after working on the tubes) it has been shifted in such a manner that the lug 76 (FIG. 7) enters the recess 77, in such a manner as to return the drum to its correct position. In this position, the channel 96 is opposite one of the emptying tubes provided in the device. Thus the drum 95 is located in a suitable and well defined position. The lug on the upper part of the drum 95 allows the operator to position the plate 20 of the holding stack in its correct position. In other words, the lug on the upper part forms locating means for the reassembly of the holding stack.

Figure 15:
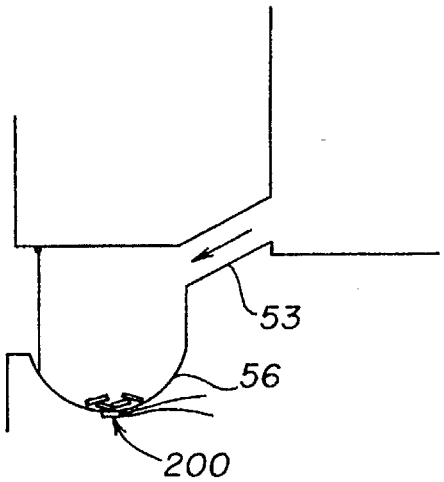
FIG. 15 shows the tray schematically, provided with a sensor.

As shown schematically in FIG. 15, the apparatus of the invention comprises means for checking that coins the return of which has been commanded have reached the tray. These means are formed by a piezoelectric sensor 200 located at the bottom of the tray and adapted to issue a signal as soon as the tray contains even one of the change coins. The piezoelectric sensor is also associated with the central unit of the apparatus, in such a manner as to be able to disable the change channel or to produce an alarm when it fails to sense the arrival of a coin, this being indicative that the output for return of change has been inappropriately blocked, as a result of an act of vandalism, for example.

The means which thwart any attempt at vandalism by removing coins contained in a tube offset radially and ready to be lifted up, with a view to its removal are described below with reference to FIGS. 16 and 17. These means are intended to prevent any picking operation seeking to extract the coins contained in the tubes. These means comprise, with reference to FIGS. 16, 17 and 18, a generally U shaped member 130 extending towards the base of the drum 95, i.e. in the direction of the tray. More particularly, the U-shaped part 130 extends though the aperture 38 into the interior of the hopper and is so positioned as to continue towards the bottom, i.e. toward the hopper, a tube being located in the axial channel 96 with a view to removal of such tube. With reference to FIG. 18, it can be seen that the drum 95 and more particularly its means of rotation 131 are fixed on the free end of a radial tongue 132 (obstructing the circular opening 38 communicating with the tray).

Figure 16:
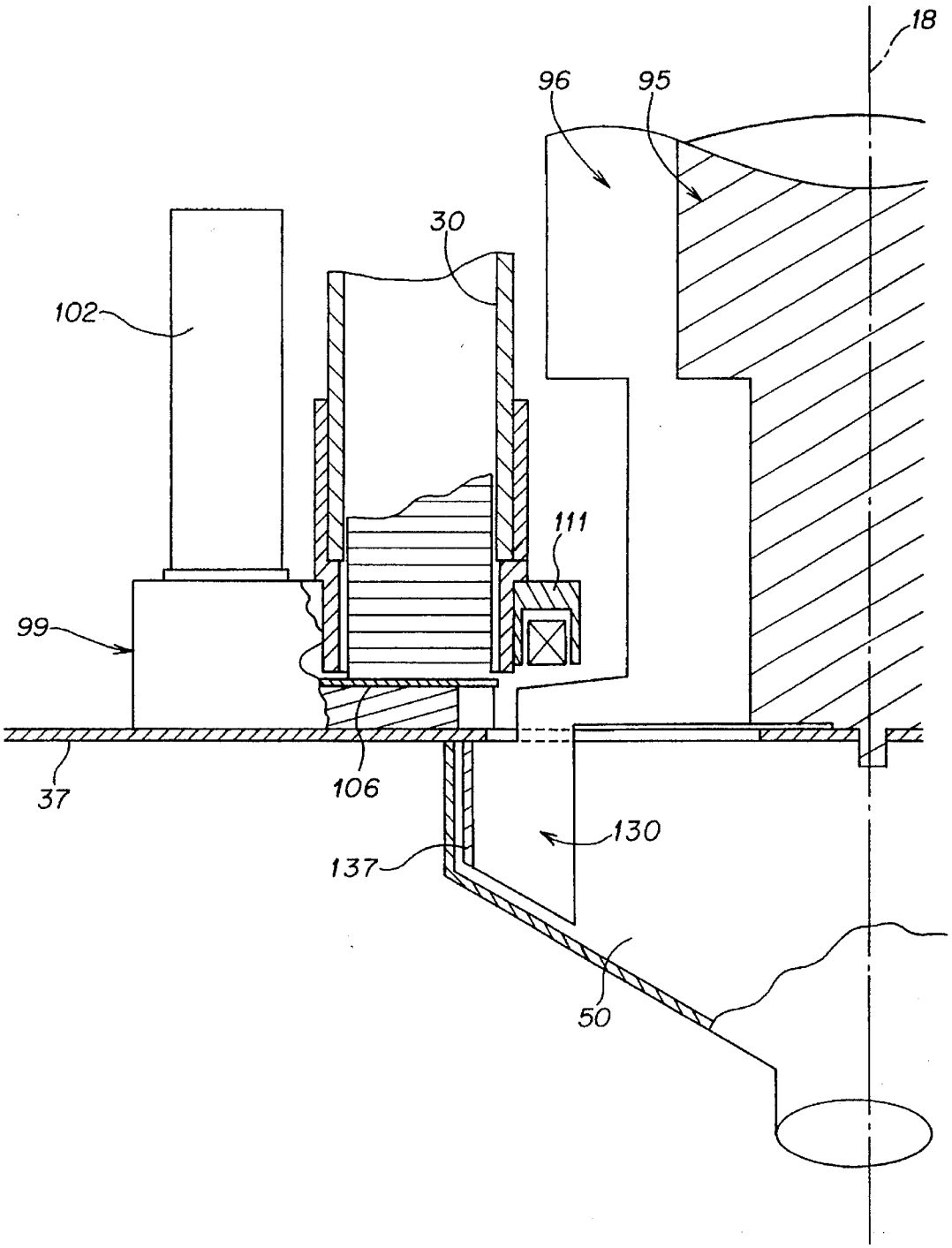
FIG. 16 is a partial view, in section, of the tube and the associated parts of the central drum comprising anti-lock-picking means and part of the tray.
Figure 17:
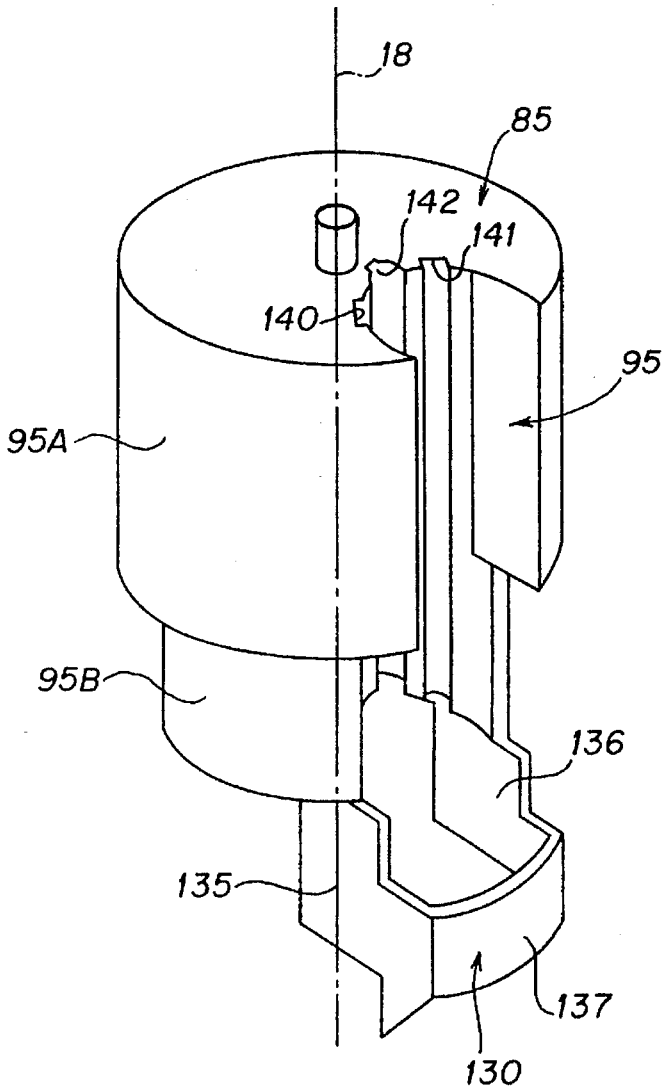
FIG. 17 is a schematic perspective view of the drum carrying anti-lock-picking means.
Figure 18:
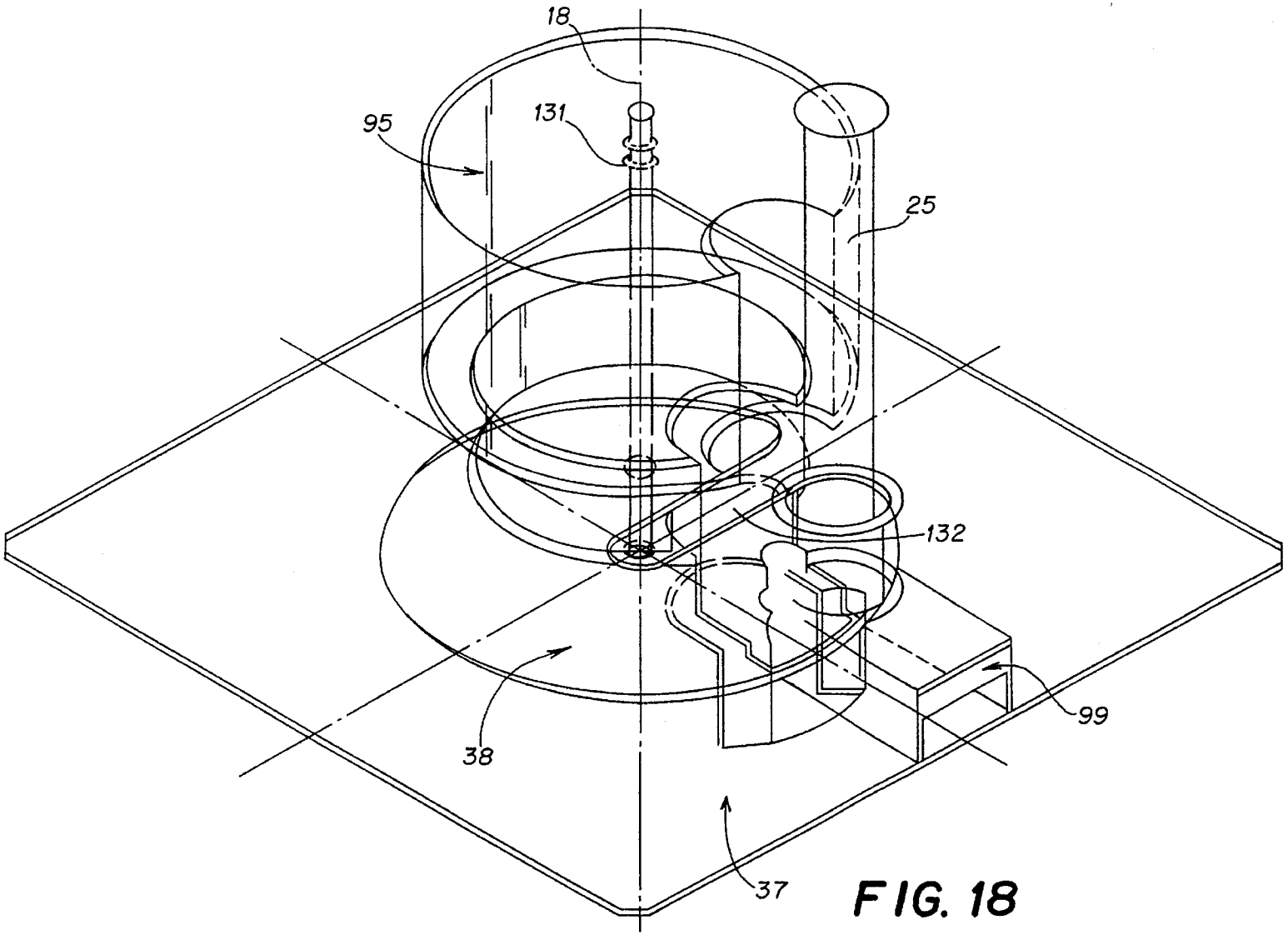
FIG. 18 is a perspective view of the drum and a tube located on the base of the cash container.

As shown in FIGS. 16 and 17, the anti-picking part 130 has two sidewalls 135 and 136 parallel to one another and parallel to the axis of rotation 18 of the drum 95. More particularly, the sidewalls 135, 136 are provided substantially as an extension of the axial channel 96 receiving the tubes. A transverse connecting panel 137 is provided between the side panels 135 and 136. The transverse panel 137 is located frontally relative to the drum and facing and near to the vertical wall of the hopper, as shown more particularly in FIG. 16.

Other sensors (e.g. optical, ultrasonic) or mechanical devices can be used to ensure that the coin outlet chute is clear from any object which could block the output of coins to the tray. For example, the mechanical device could be a sweeper that sweeps the opening before returning any change to ensure that nothing is blocking the opening.

By monitoring the coin output chute before authorizing payment by the return of coins the security of the transaction can be reinforced in that the return of coins is not authorized if the tray output is obstructed.

It can be seen from FIG. 17 in particular that the drum has two parts, namely an upper part 95A and a lower part 95B of smaller diameter.

It will be understood from the preceding that, once the drum is in position, i.e. the channel 95 is opposite the tube to be removed, and the tube is located inside the channel 96, it is more or less impossible to recover coins during the emptying of the tube by any picks or by the introduction of objects through the opening 38 which seek to recover coins before they have reached the bottom of the tray 50. The anti-picking device forms a complementary part for the security of the operator.

Figure 19:
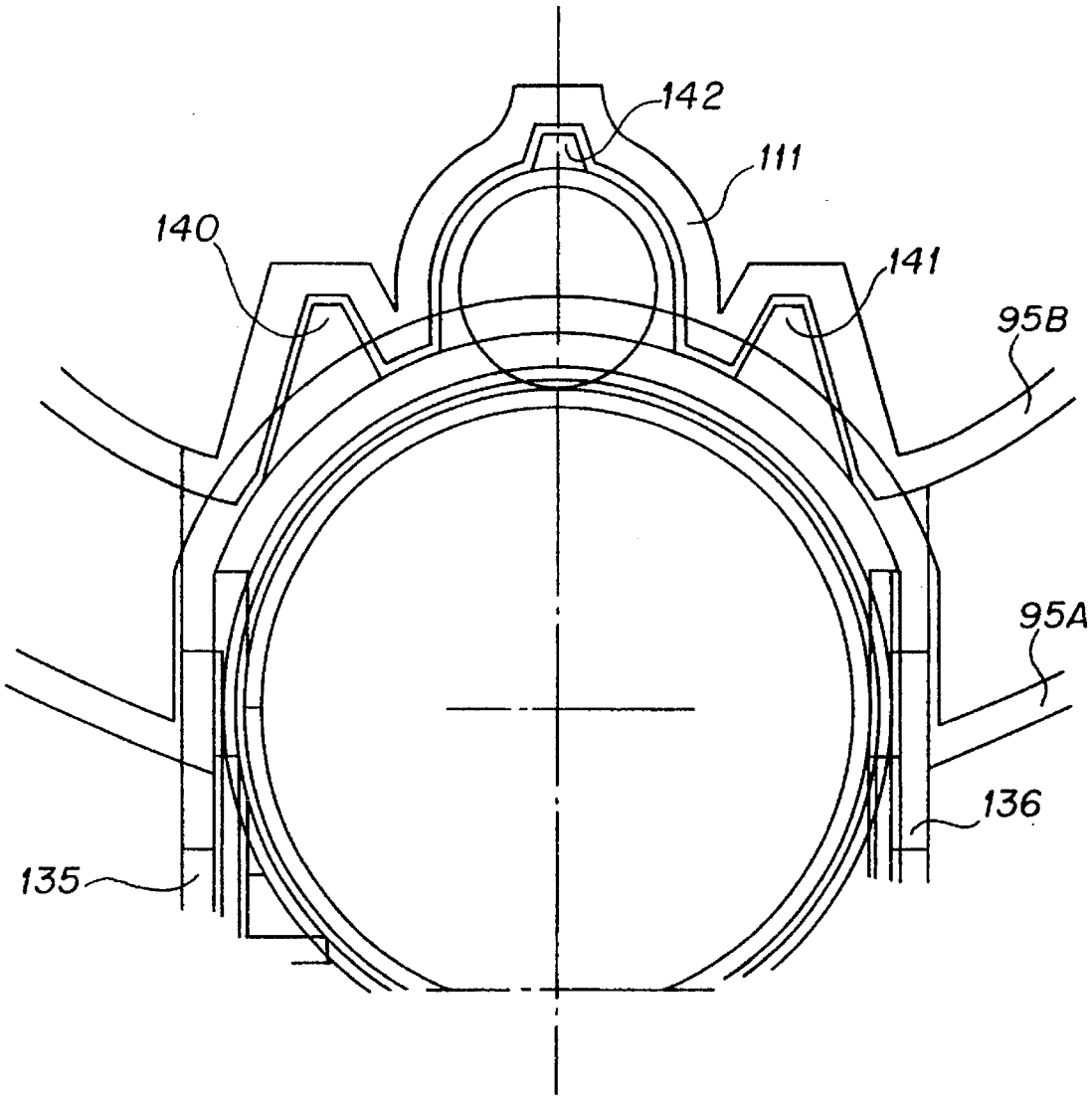
FIG. 19 shows in more detail the end of the tube and of the central drum comprising anti-lock-picking means for the tube.

FIGS. 12B, 13B and 19 show one embodiment of the anti-fraud device, in a view from above, for blocking in an optimum manner the space between the front end of each tube support assembly 99 and the inner wall of the channel 96 provided in the lower part 95A of the drum 95. As also shown in FIG. 17, the front end (facing the axis 18) of the support base of the assembly 99 is provided with projecting parts 140, 141 and 142 (forming a kind of comb) with a form complementary to that of axial grooves provided in the inner face of the main channel 96, disposed in the lower part 95B. FIG. 18 does not show the groove and comb structure merely for the sake of simplicity.

Although a preferred embodiment of the present invention has been described in detail above, various modifications thereto will be readily apparent to one with ordinary skill in the art. All such modifications are intended to fall within the scope of the present invention as defined by the following claims.

We claim:

1. Apparatus for sorting and storing objects, such as coins, inserted by way of payment in a dispenser of products or services, comprising:

a coin input unit into which the objects are input, a selector connected to the coin input unit and adapted to sort the objects, said selector including an outlet connected to a tray and to holding means for said objects, a removable recycling dispenser, a lockable final storage means for the objects, means for directing said objects from said holding means to one of:

said tray, or said lockable final storage means for said objects, or said removable recycling dispenser, said removable recycling dispenser having means for storing said objects temporarily and for directing said temporarily stored objects either to said tray or to said final storage means, said means for storing comprising at least two vertical tubes for temporarily storing said objects, and means for preventing visual and physical access to an interior of said tubes when the tubes are installed in position, said means for preventing including emptying means for automatically directing the objects contained in at least one of said tubes to said lockable final storage means, which is locked, as a preliminary to removal of each said tube.

2. Apparatus according to claim 1, including means for allowing removal of only one tube at a time.

3. Apparatus according to claim 1, wherein said holding means includes a rotary barrel in which the objects are adapted to be held, and in which said tubes are disposed in a circle centered on said barrel.

4. Apparatus according to claim 3, wherein said holding means also includes a plate on which the barrel is fixed, said plate being adapted to be covered by a casing and said plate being located at the top of a cash container containing the recycling dispenser.

5. Apparatus according to claim 3, including means for allowing the barrel of the holding means to empty as a preliminary to removal and access to said barrel.

6. Apparatus according to claim 1, including means for discharging objects from the tubes one by one and comprising a slider.

7. Apparatus according to claim 2, wherein each tube can be moved radially between a first, blocked position and a second position for removal, offset radially towards a interior of the circle formed by the tubes, said means for allowing removal of one tube at a time comprising a drum provided with an axial groove formed complementary to said tube to be removed and adapted to receive the latter at least partially.

8. Apparatus according to claim 6, including a projecting part on the slider adapted to come into abutment with a shoulder on a fixed base relative to which said tube is displaced.

9. Apparatus according to claim 7, including an anti-picking device for the tubes, extending a base of the drum in a region of the groove.

10. Apparatus according to claim 1, including at least one sensor adapted to detect free circulation of coins during operations returning change.

11. Apparatus according to claim 1, including at least one sensor for checking that the tray is not blocked.

12. Apparatus according to claim 1, further including routing means at an outlet of said recycling dispenser, said routing means comprising:

a first channel connected to said tray, a second channel connected to said final storage means, a hopper having a bottom with an aperture thereat, said aperture opening into said first and second channels, a flap adapted to selectively block one of the channels, actuating means for controlling said flap to selectively block one of the channels such that the flap closes access to the tray in a normal position and provides access to the second channel connected to the final storage means.

* * * * *